US008230692B2

(12) United States Patent
Moon et al.

(10) Patent No.: US 8,230,692 B2
(45) Date of Patent: Jul. 31, 2012

(54) WATER DISPENSER AND METHOD OF PURIFYING WATER

(75) Inventors: Young Mu Moon, Kyungki-do (KR); Hyung Min Park, Kyungki-do (KR); Young Wook Kim, Kyungki-do (KR)

(73) Assignee: CLOVER Company Ltd., Anyang-si, Kyungki-do (KR)

( * ) Notice: Subject to any disclaimer, the term of this patent is extended or adjusted under 35 U.S.C. 154(b) by 663 days.

(21) Appl. No.: 12/403,829

(22) Filed: Mar. 13, 2009

(65) Prior Publication Data

US 2010/0212333 A1 Aug. 26, 2010

(30) Foreign Application Priority Data

Feb. 23, 2009 (KR) ..... 10-2009-0015012

(51) Int. Cl.
*F25B 1/00* (2006.01)

(52) U.S. Cl. ..... 62/115; 62/338

(58) Field of Classification Search ..... 62/338, 62/389, 394, 395; 222/146.6, 592; 204/274; 250/504 R See application file for complete search history.

(56) References Cited

U.S. PATENT DOCUMENTS

| | | | | |
|---|---|---|---|---|
| 4,958,747 | A * | 9/1990 | Sheets | 222/67 |
| 6,126,797 | A * | 10/2000 | Sato et al. | 204/272 |
| 6,267,855 | B1 * | 7/2001 | Watanabe et al. | 204/272 |
| 6,469,308 | B1 * | 10/2002 | Reed | 250/436 |
| 6,648,174 | B2 * | 11/2003 | Greene | 222/66 |
| 7,175,760 | B2 * | 2/2007 | Cary et al. | 210/123 |
| 2002/0162969 | A1 * | 11/2002 | Reed | 250/432 R |
| 2003/0094011 | A1 * | 5/2003 | Zakryk et al. | 62/291 |
| 2003/0132250 | A1 * | 7/2003 | Greene | 222/185.1 |
| 2004/0129723 | A1 * | 7/2004 | Meder et al. | 222/113 |
| 2004/0226313 | A1 * | 11/2004 | Busick | 62/397 |
| 2005/0156119 | A1 * | 7/2005 | Greene | 250/436 |
| 2006/0151715 | A1 * | 7/2006 | Greene | 250/453.11 |
| 2007/0075006 | A1 | 4/2007 | Watanabe et al. | |

FOREIGN PATENT DOCUMENTS

| | | |
|---|---|---|
| EP | 1030143 | 2/2000 |
| GB | 2450518 | 12/2008 |
| JP | 09-103771 | 4/1997 |
| JP | 09-285780 | 11/1997 |
| JP | 2000-033372 | 2/2000 |
| KR | 1020050113325 | 12/2005 |

* cited by examiner

*Primary Examiner* — Mohammad Ali
(74) *Attorney, Agent, or Firm* — Lowe Hauptman Ham & Berner, LLP

(57) ABSTRACT

A water dispenser is provided, which includes a cold water container configured to store water therein, having a hollow portion; a water purification device fluidly connected to the cold water container and configured to purifying the water supplied from the cold water container, the water purification device being installed inside the hollow portion of the cold water container; and a cooling device installed outside the cold water container and configured to cool the water stored in the cold water container.

14 Claims, 6 Drawing Sheets

WATER DISPENSER AND METHOD OF PURIFYING WATER

BACKGROUND

The present disclosure relates to a water dispenser, and in particular to a water dispenser which includes a cold water container having a water storing space, a water purification device installed to purify water, a cooling device installed outside the cold water container for cooling water in the cold water container, and a refrigerator having an insulator outer wall that accommodates the cold water container, the water purification device and the cooling device.

Generally, water supplied through water pipes may contain various harmful pollutants due to degradation of pipes. Many consumers who use tap water supplied through water pipes, increasingly to use a water dispenser for removing various harmful pollutants and to cool and/or heat water.

FIG. 1 is a view illustrating a conventional water dispenser, and FIG. 2 is a view illustrating a structure of the water dispenser of FIG. 1.

As shown in FIGS. 1 and 2, the water fed through water pipes is purified by means of a purification device 11 and is stored in a water storing container 12. The water purification device 11 may be formed from various water purification devices such as a filter using active carbon or any adsorptive materials known in the pertinent art.

A cold water container vent 13 is installed in the water storing container 12, by which water can remain at a certain level. The water stored in the water storing container 12 moves into the cold water container 14 and is cooled by means of the cooling device 15 or moves into a hot water container 16 and is heated by means of a heating device 17.

The cold water cooled by means of the cold water container 14 is discharged to the outside through a cold water discharge tap 18, and the hot water heated by the hot water container 16 is discharged to the outside through a hot water discharge tap 19.

When the water purified by means of the water purification device 11 is stored in the water storing container 12 for a long time at room temperature, the water may be polluted due to various microorganisms. Since the water storing container 12 is exposed to air, bacteria contained in air may permeate into the water storing container 12, which will also lead to polluting water.

In addition, since the water storing container 12 and the water purification device 11 are separately installed from each other, the inner space of the dispenser housing is not efficiently used, and the size of the water dispenser 100 is disadvantageously large.

SUMMARY

Accordingly, it is an object of one or more embodiments to provide a water dispenser which overcomes the problems encountered in the conventional water dispenser.

It is another object of one or more embodiments to provide a water dispenser for preventing water from being polluted, which directly discharges the water purified by means of a water purification device to the outside so that the purified water is not stored in a certain place in the water dispenser.

It is yet another object of one or more embodiments to provide a water dispenser which makes it possible to minimize the space of a water purification device and a water storing container by forming a space in the center of a water storing container for accommodating a water purification device, and by fixedly inserting the water purification device into the space, whereby it is possible to significantly decrease the entire volume of the water dispenser.

To achieve the above objects, there is provided a water dispenser configured to cool and purify water which comprises a cold water container; a water purification device installed in an accommodation space adjacent the center of the cold water container for purifying the water supplied from the cold water container; a cooling device installed outside the cold water container for cooling the water stored in the cold water container; a refrigerator which has an outer wall made of an insulation material and has a certain space formed for accommodating the cold water container, the water purification device and the cooling device, respectively; a cold water valve which is connected with the water purification device for supplying the purified cold water; and a water outlet pipe for discharging cold water supplied from the cold water valve.

There is further provided a hot water container, disposed in an outer side of the refrigerator, which includes a heating device for receiving the purified water from the water purification device and heating the same; a hot water valve which is connected with the hot water container for supplying hot water; and a water outlet pipe for discharging the hot water supplied from the hot water valve.

The hot water valve includes a hot water container vent for discharging part of the hot water stored in the hot water container to the outside when the volume of the hot water stored in the hot water container is expanded.

The cooling device may be in close contact with an outer surface of the cold water container with its both ends being fixed by means of an engaging member while it is bent in a shape conforming to an outer surface of the cold water container.

There is further provided a water supply valve connected with an external water pipe, with the water supply valve being opened or closed in cooperation with the cold water valve or the hot water valve.

BRIEF DESCRIPTION OF THE DRAWINGS

One or more embodiments disclosed in the present application will be better understood with reference to the accompanying drawings which are given only for illustrative purposes and thus are not limitative on the scope of embodiments.

DESCRIPTION OF EMBODIMENTS

Figure 1:
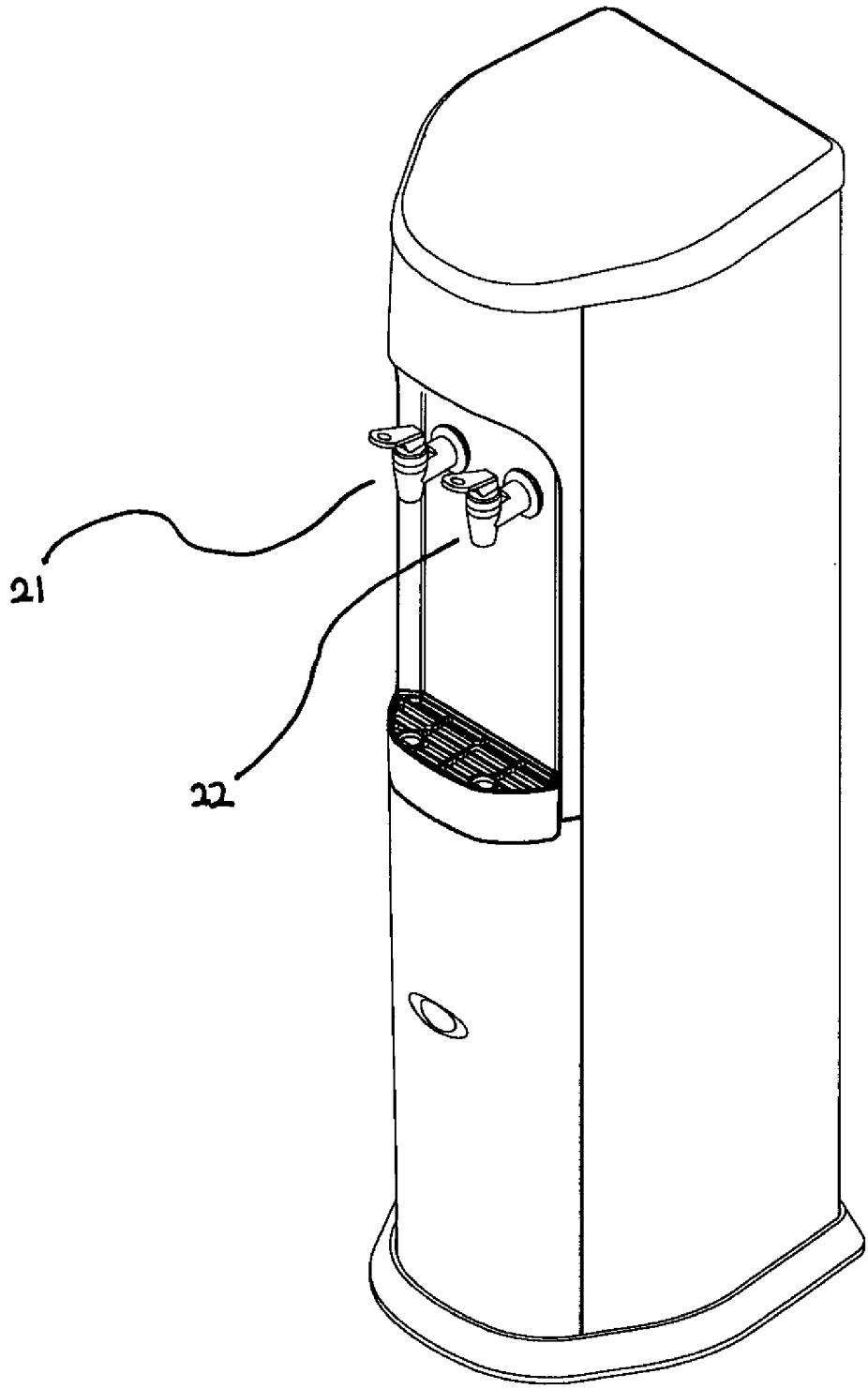
FIG. 1 is a perspective view illustrating a conventional water dispenser.
Figure 2:
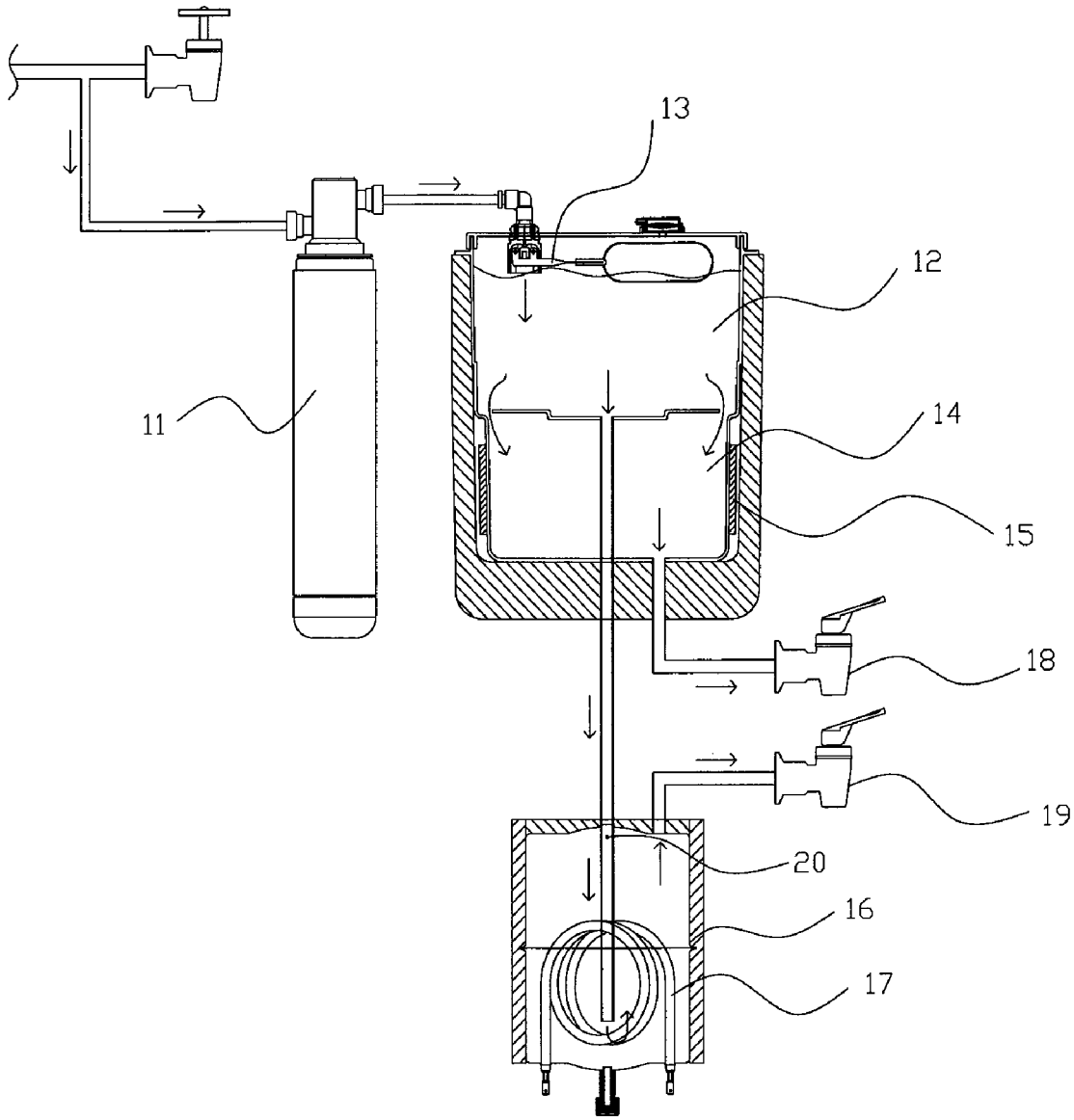
FIG. 2 is a schematic view illustrating a structure of the water dispenser of FIG. 1.
Figure 3:
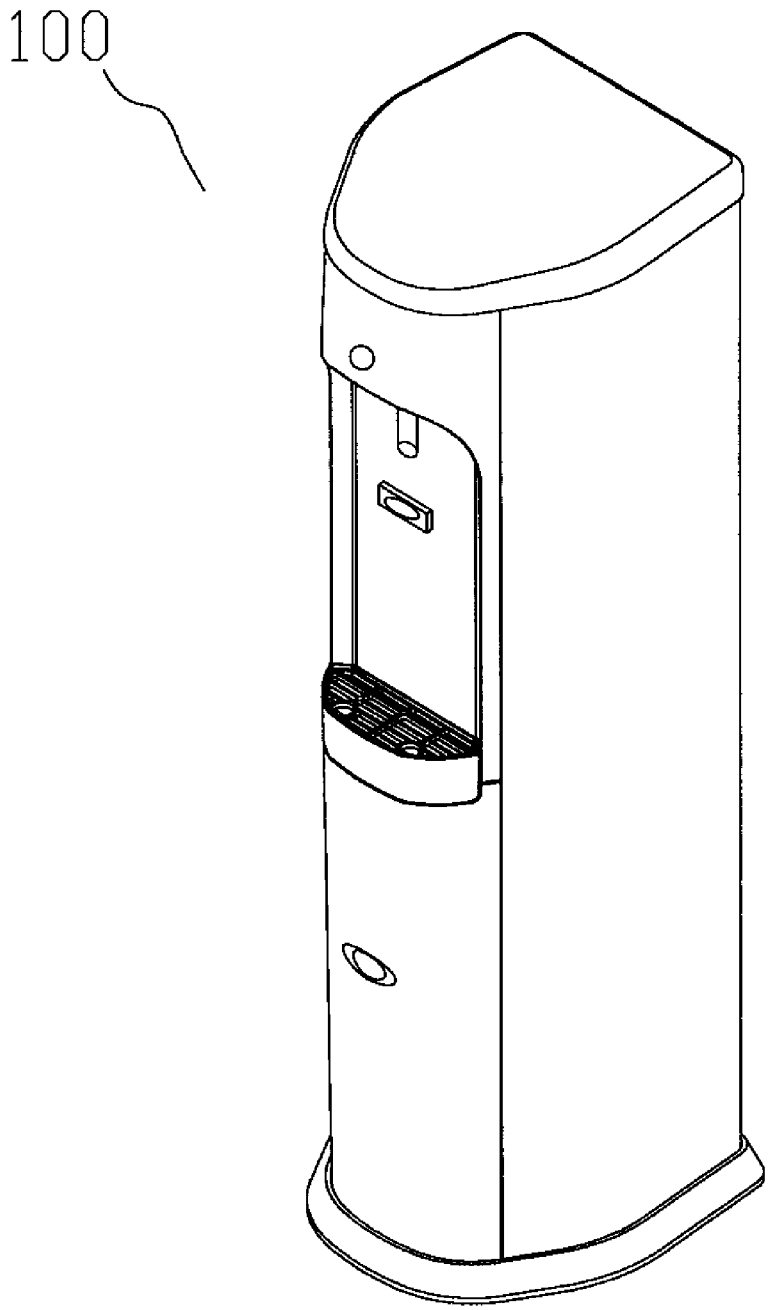
FIG. 3 is a perspective view illustrating a water dispenser according to one embodiment.

As shown in FIGS. 3 through 6, a water dispenser 100 according to one embodiment comprises a cold water container 101, a water purification device 102, a refrigerator 103 and a water outlet pipe 106.

The cold water container 101 includes a cooling device 104 for receiving water, for example, from a water pipe and for cooling and storing the same. For instance, the cold water container 101 is a sealed type pressure container.

The water purification device 102 is fluidly connected with the cold water container 101, thereby purifying the cold water in the cold water container 101. The water purification device 102 may be formed from various water purification devices such as a filter with active carbon or any adsorptive materials known in the art.

The refrigerator 103 includes a certain space therein for cooling and storing the cold water container 101 and the water purification device 102. According to one embodiment, the refrigerator 103 is cooled by means of the cooling device 104 provided adjacent the outer surface of the cold water container 101. Alternatively, the cooling device 104 may be separately provided.

According to one embodiment, the refrigerator 103 includes an outer wall made of an insulation material having a low heat transfer rate.

The water purified by means of the cooled water purification device 102 may be directly discharged to the outside through a cold water valve 105 and a water outlet pipe 106.

In the water dispenser 100 according to one embodiment, the water supplied from the outside is cooled in the cold water container 101 and is stored therein. When the cold water valve 105 is opened, the water can be directly discharged through the cooled water purification device 102. Since the purified water is not exposed to air at room temperature while being stored, a secondary pollution due to the growth of microorganisms can be reliably prevented.

In accordance with one or more embodiments, the water purification device 102 is disposed in a space adjacent the center portion of the cold water container 101. The space adjacent the center portion of the cold water container 101 may be a hollow portion of the cold water container 101, for example, when the cold water container 101 is made in the shape of a hollow cylinder or cubic.

Figure 5:
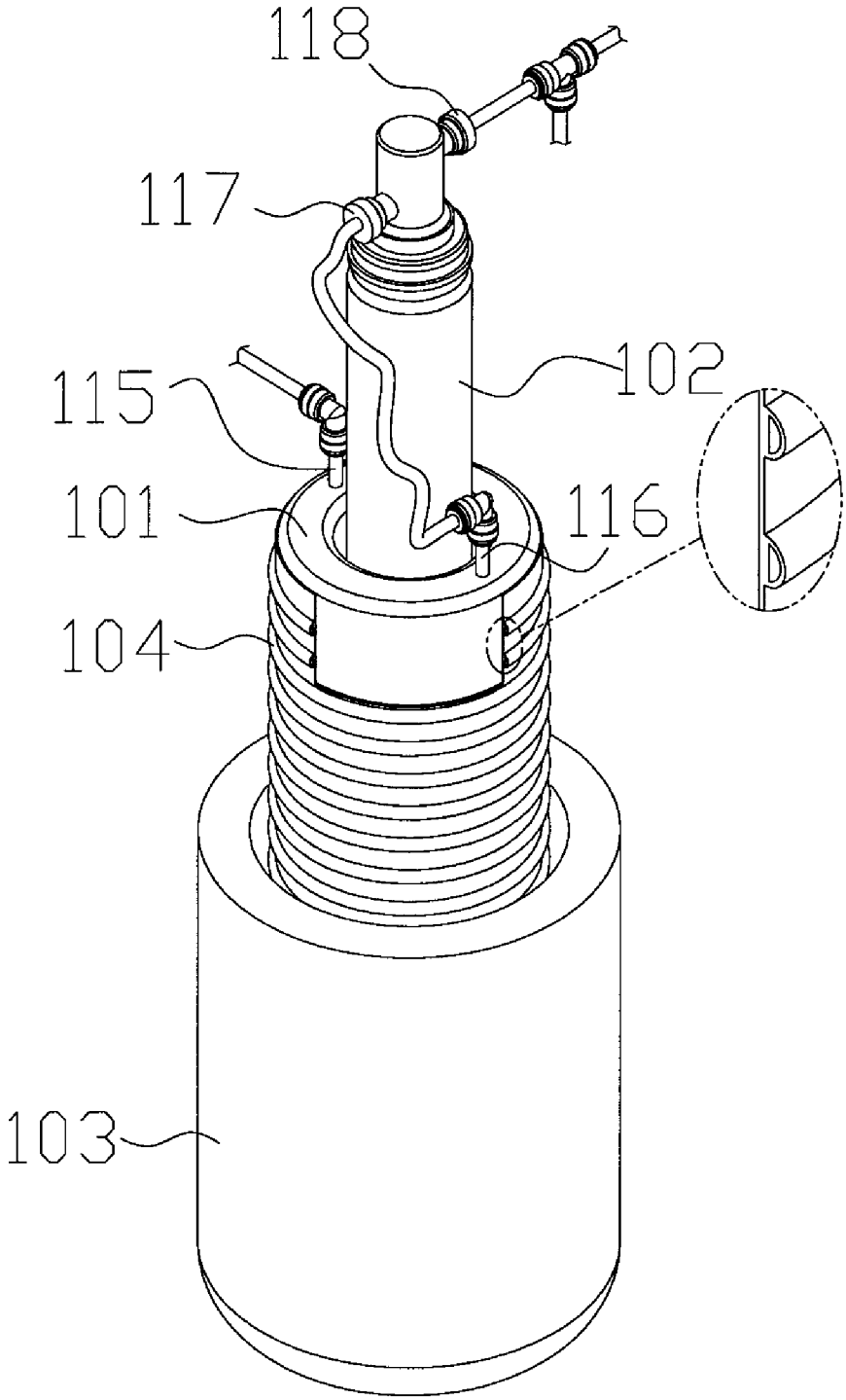
FIG. 5 is a perspective view illustrating a disassembled structure of a cold water container and a water purification device according to one embodiment.
Figure 6:
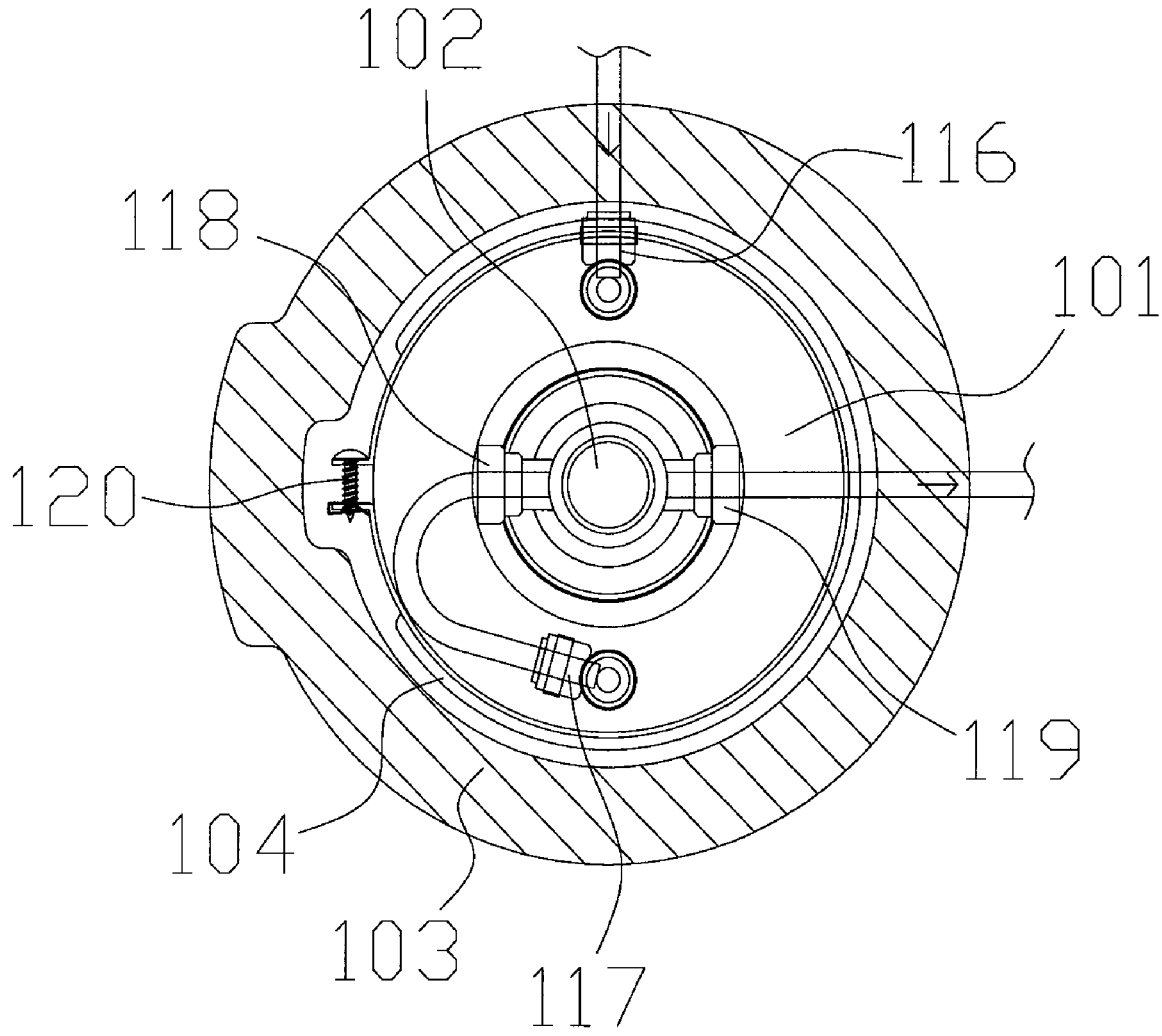
FIG. 6 is a cross sectional view illustrating an assembled structure of a cold water container and a water purification device according to one embodiment.

As shown in FIGS. 5 and 6, the refrigerator 103 is equipped with an accommodation space in its interior. The cold water container 101 and the water purification device 102 are accommodated in the accommodation space formed in the interior of the refrigerator 103. The water purification device 102 is accommodated in a hollow portion of the cold water container 101.

According to one embodiment, the cold water container 101 is formed in the shape of a hollow cylinder or cubic, and has an inner surface 101*a* and an outer surface 101*b*. In accordance with one embodiment shown in FIG. 4, an accommodation space may be formed in a hollow portion inside the inner surface 101*a*, and the outer surface 101*b* surrounds the inner surface 101*a*.

According to one embodiment, a water storing space is formed in a space between the inner and outer surfaces 101*a* and 101*b*. The water storing space may be defined by a top and a bottom surface of the cold water container 101, in addition to the inner and outer surfaces 101*a* and 101*b*. The cold water container having a water storing space may be formed in one piece, or may be integrated from multiple pieces by any method known in the pertinent art.

The water purification device 102 is installed in a hollow portion inside the inner surface 101*a*, and the water supplied from the outside (for example, tap water which is not cooled and purified) is stored in the storing space formed between the inner and outer surfaces 101*a* and 101*b*.

According to one embodiment employing a cold water container having the inner and outer surfaces 101*a* and 101*b*, the water purification device 102 is installed in the innermost space (namely, a space surrounded by the inner surface 101*a*), and water is stored in the next space (namely, a space formed between the inner and outer surfaces 101*a* and 101*b*).

In one embodiment, since the water purification device 102 is disposed in an accommodation space formed adjacent the center of the cold water container 101, a water storing space might decrease as compared to a cold water container 101 having no accommodation space therein. However, since the outer diameter of the cold water container 101 can be increased as much as the accommodation space of the water purification device 102, it is possible to compensate for the space occupied by the water purification device 102.

When a cylindrically or cubically rectangular shaped cold water container 101 and a water purification device 102 are separately installed, an unoccupied space might be formed between these two elements. When the water purification device 102 is installed in the hollow portion of the cold water container 101 according to one embodiment, such an unoccupied space can be prevented by maximizing the efficiency of space in the system.

When the cold water container 101 and the water purification device 102 are formed in cylindrical shapes according to one embodiment, it is possible to store the same amount of water as that of a conventional system by slightly increasing the outer diameter of the cold water container 101, for example, by about 3~4 cm, even when a certain accommodation space for the water purification device 102 is formed in the cold water container 101.

According to one embodiment, the cold water container 101 and the water purification device 102 are formed in a cylindrical shape or a cubical shape. Although FIGS. 5-6 show one embodiment employing a cold water container formed in a hollow cylindrical shape, they are not intended to limit the shapes of the cold water container. One of ordinary skill in the art will appreciate that any known structure of containers may be used in one or more embodiments.

Referring back to FIG. 4, the water supplied into the water dispenser 100 is fed into the cold water container 101 through a cold water container water inlet 115 that may be formed on the upper side of the cold water container 101 and is cooled while staying in the cold water container 101. The cooled water is discharged through a cold water container outlet 116 that may be formed on the opposite area of the upper side of the cold water container 101.

The cold water container outlet 116 is connected with a water purification device inlet 117, and the water inputted into the interior of the water purification device 102 through the water purification device inlet 117 is purified while passing through the filter of the water purification device 102.

The filtered water is discharged through a water outlet pipe 106 after passing through a water purification device outlet 118.

According to one embodiment, since the water purification device 102 is surrounded by the cold water container 101, the cooling effect obtained with the aid of the cold water can be uniformly applied to the water purification device 102. Since temperature change due to the difference in the height of the water purification device 102 is small, the temperature of the water stored in the water purification device 102 can remain relatively constant.

When purified water is supplied to a user, part of the water stored in the interior of the water purification device 102 is discharged. When the temperature of the water stored in the interior of the water purification device 102 is kept constant, the water discharged first and the water discharged later have similar temperatures.

As shown in FIG. 5, the cooling device 104 of one embodiment is installed by surrounding the outer wall of the cold water container 101.

According to one embodiment, the cooling device 104 may be formed in a metallic flat plate structure, and may be equipped with a refrigerant flow pipe. As shown in FIG. 6, the cooling device 104 may be bent into a shape conforming to the outer surface of the cold water container 101, thereby surrounding or contacting the outer surface of the cold water. According to one embodiment, both ends of the cooling device may be fastened to each other, or fixed to the outer wall of the cold water container 101 by means of an engaging member 120 such as a screw or by any know mechanism known in the pertinent art. When the engaging member 120 is unfastened, the cooling device 104 and the cold water container 101 can be separated. When exchanging or cleaning the cold water container 101, the cooling device 104 may be separated, and only the cold water container 101 may be removed from the dispenser, so that cleaning and repair can be easily performed.

Figure 4:
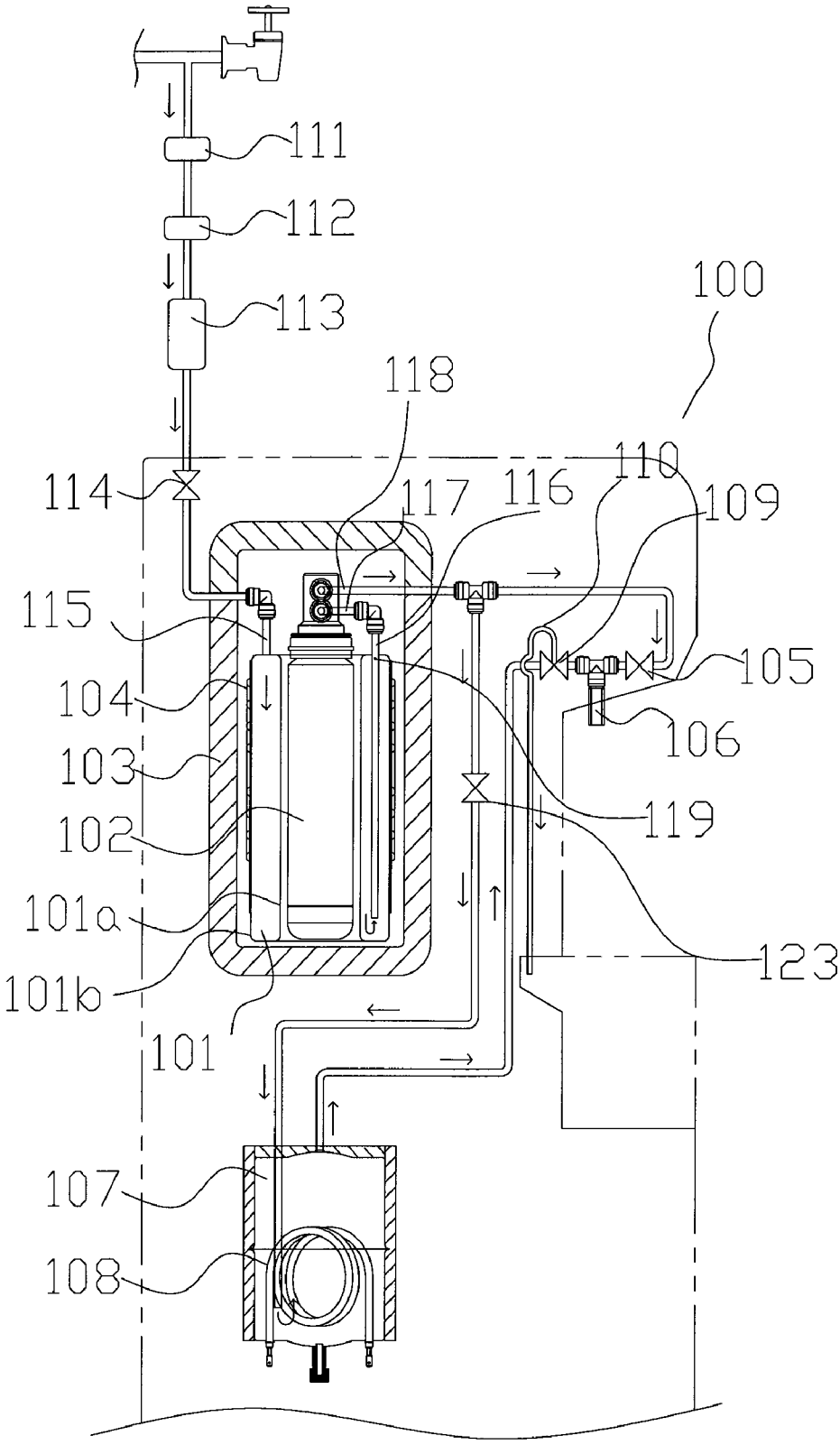
FIG. 4 is a cross sectional view illustrating the elements of a water dispenser according to one embodiment.

Referring to FIG. 4, the water dispenser 100 according to one embodiment is further equipped with a water supply valve 114 for controlling the flow of water which is supplied from the outside. The water supply valve 114 is controlled in cooperation with a cold water valve 105 or a hot water valve 109. When cold water is discharged, the water supply valve 114 is opened and closed in cooperation with the cold water valve 105, and when hot water is discharged, it is opened or closed in cooperation with the hot water valve 109 and a hot water supply valve 123. According to one embodiment, the water supply valve 114 may be open only when cold water or hot water is discharged through the water outlet pipe 106.

These features can contribute to preventing water pipe leakage as high pressure water is transferred to the water dispenser 100.

A cold water container vent 119 is provided in the cold water container outlet 116 through which the cooled water in the cold water container 101 is discharged. The cold water container vent 119 is formed by forming a small hole in the uppermost portion of the pipe extended from the cold water container outlet 116 into the cold water container 101 for discharging air from the cold water container 101.

A hot water container 107 is disposed outside the refrigerator 103 for receiving the purified water from the water purification device and storing the same. The hot water container 107 is equipped with a heating device 108 such as an electric heater or any known heating equipment for heating the purified water and storing the same.

In accordance with one embodiment, a hot water container vent 110 is installed in the hot water valve 109, so that an excessive volume of water that expands due to temperature increases in the hot water container 107 is discharged to the outside (for example, to a water discharge container).

The hot water valve 109 may be formed as a 3-way valve, one outlet of which is used as a vent.

The hot water vent 110 may be kept closed while the hot water valve 109 is opened, and hot water is discharged to the water discharge pipe 106. It may be opened when the hot water valve 109 is closed.

The hot water stored in the hot water container 107 is discharged to the outside through the water outlet pipe 106. Since the water stored in the hot water container 107 is heated to a high temperature, the water is not polluted due to bacteria.

Although the cold and hot water can be discharged through the same water outlet pipe 106 according to one embodiment described above, those skilled in the art will appreciate that they can be discharged through separate discharge outlets, respectively.

As shown in FIG. 1, a cold water button 121 and a hot water button 122 may be separately provided on the front side of the water dispenser 100 according to one embodiment.

The cold water button 121 may be installed right below the water outlet pipe 106. When a user pushes the cold water button 121 with a cup under the water outlet pipe 106, the cold water valve 105 is opened, so cold water can be discharged through the water outlet pipe 106.

When the hot water button 122 and the cold water button 121 are concurrently pushed, the hot water valve 109 is opened, and hot water can be discharged through the water outlet pipe 106. Given the aforementioned structure of water dispenser system, any burns by hot water can be prevented by allowing the hot water button 122 and the cold water button 121 to be concurrently pushed.

The water dispenser 100 according to one embodiment can further include an external water purification device (not shown) outside the refrigerator 103. The external water purification device (not shown) is configured to receive water to purify and supply it to the hot water container 106.

Since much energy is needed for supplying the cooled water in the cold water container 101 to the hot water container 107 and then heating the same, water at room temperature may be supplied to the hot water container through the above external water purification device (not shown). The external water purification device (not shown) may be a device having any known filtration mechanism, and optionally employed by taking into account a cost saving due to energy efficiency and a cost increase due to the addition of the external water purification device (not shown).

A room temperature water valve (not shown) might be further provided for directly discharging water at room temperature purified by means of the external water purification device (not shown).

According to one embodiment, when the pressure of water supplied to the cold water container is low, the amount of purified water decreases, which may lead to a decrease in the amount of discharged cold water.

In order to overcome the above problems, the water dispenser 100 according to one embodiment further includes a pressurizing pump 111 for increasing the pressure of water to be supplied to the cold water container 101.

Given the above structure of dispenser, it is possible to efficiently discharge cold water by increasing the amount of purified water even when the dispenser is used in a place where water pressure is low.

The water dispenser 100 according to one embodiment further includes a reducing valve 112 which is provided to decrease the pressure of water to be supplied to the cold water container 101.

When the water dispenser 100 is used in a place where water pressure is high, a water leakage problem may occur. In order to overcome this problem, a reducing valve 112 is further provided for thereby decreasing the water pressure to a proper level.

It is possible to obtain reliable water purification and adequate amount of water while maintaining a water pressure appropriately by use of the pressurizing pump 111 or the reducing valve 112.

Referring to FIG. 4, The water dispenser 100 according to one embodiment further includes a pretreatment filter 113 for removing floating pollutants from water supplied to the cold water container 101. Tap water supplied to the cold water container 101 may include pollutants such as water scale, rust, and solid particles, so it is needed to filter these pollutants using the pretreatment filter 113 in order to prevent such pollutants from being accumulated in the cold water container 101.

According to one or more embodiments, it is possible to significantly decrease the entire volume of a water dispenser as compared to a conventional water dispenser in such a manner that a refrigerator, a cooling device, a cold water container and a water purification device are arranged in a concentric shape.

A secondary pollution due to the growth of microorganisms that may arise since purified water is directly exposed to air and is stored at room temperature can be prevented in such a manner that water is cooled before purification, and is purified when it is needed, and purified water is directly discharged to the outside.

Since a water purification device, a cold water container, and a cooling device can be easily separated, a repair or cleaning work can be performed more conveniently. As the claimed invention may be embodied in several forms without departing from the spirit or essential characteristics thereof, it should also be understood that the above-described examples are not limitative by any of the details of the foregoing description, unless otherwise specified, but rather should be construed broadly within its spirit and scope as defined in the appended claims, and therefore all changes and modifications that fall within the meets and bounds of the claims, or equivalencies of such meets and bounds are therefore intended to be embraced by the appended claims.

What is claimed is:

1. A water dispenser for cooling and purifying water, comprising:

a cold water container having a water storing space to store water to be purified therein, and a hollow portion;

a cooling device installed outside the cold water container and configured to cool the water stored in the cold water container;

a water purification device fluidly connected to the cold water container and configured to purify the cooled water supplied from the cold water container, the water purification device being installed inside the hollow portion of the cold water container;

a refrigerator having an outer wall made of an insulation material and having a space formed therein for accommodating the cold water container, the water purification device, and the cooling device; and a cold water valve connected with the water purification device and configured to directly discharge the purified water.

2. The dispenser of claim 1, further comprising:

a hot water container disposed outside the refrigerator, including a heating device configured to receive the purified water from the water purification device and to heat the same;

a hot water valve connected with the hot water container and configured to receive the heated water from the hot water container; and a water outlet pipe provided to discharge the heated water supplied from the hot water valve.

3. The dispenser of claim 2, wherein said hot water valve includes a hot water container vent provided to discharge part of the heated water being stored in the hot water container to an outside when a volume of the heated water being stored in the hot water container increases.

4. The dispenser of claim 1, wherein said cooling device is disposed surrounding an outer surface of the cold water container.

5. The dispenser of claim 1, wherein the cooling device is disposed in contact with an outer surface of the cold water container.

6. The dispenser of claim 1, wherein the cooling device includes a refrigerant flow pipe that surrounds the cold water container.

7. The dispenser of claim 1, wherein the cooling device is installed conforming to an outside surface of the cold water container.

8. The dispenser of claim 1, wherein the cooling device has two ends being fastened to each other by an engaging mechanism.

9. The dispenser of claim 1, wherein the cold water container is formed in the shape of a hollow cylinder or a hollow cubic.

10. The dispenser of claim 1, wherein the cold water container stores the water before the water is purified by the water purification device.

11. The dispenser of claim 1, wherein the cold water container, the water purification device, and the cooling device are concentrically disposed.

12. The dispenser of claim 2, further comprising a water supply valve connected with an external water pipe, with the water supply valve being opened or closed in cooperation with the cold water valve or the hot water valve.

13. A method of cooling and purifying water, comprising the steps of:

storing water to be purified, in a cold water container having a water storing space and a hollow portion;

cooling the stored water by a cooling device disposed outside the cold water container;

purifying the water supplied from the cold water container by use of a purification device installed in the hollow portion of the cold water container; and directly discharging the purified water.

14. The dispenser of claim 1, further comprising a water outlet pipe configured to deliver the purified water discharged from the cold water valve.

* * * * *